US009382754B2

(12) United States Patent
Malkan

(10) Patent No.: US 9,382,754 B2
(45) Date of Patent: Jul. 5, 2016

(54) PLASTIC DOUBLE-CELL COVERING FOR ARCHITECTURAL OPENINGS

(75) Inventor: Sanjiv R. Malkan, Broomfield, CO (US)

(73) Assignee: Hunter Douglas Inc., Pearl River, NY (US)

( * ) Notice: Subject to any disclaimer, the term of this patent is extended or adjusted under 35 U.S.C. 154(b) by 270 days.

(21) Appl. No.: 13/806,038

(22) PCT Filed: Jun. 21, 2011

(86) PCT No.: PCT/US2011/041217

§ 371 (c)(1),
(2), (4) Date: Feb. 6, 2013

(87) PCT Pub. No.: WO2011/163205

PCT Pub. Date: Dec. 29, 2011

(65) Prior Publication Data

US 2013/0133840 A1 May 30, 2013

Related U.S. Application Data

(60) Provisional application No. 61/357,635, filed on Jun. 23, 2010.

(51) Int. Cl.
*E06B 9/26* (2006.01)
*E06B 9/262* (2006.01)

(52) U.S. Cl.
CPC ..... *E06B 9/262* (2013.01); *E06B 2009/2627* (2013.01)

(58) Field of Classification Search
CPC ..... E06B 9/262; E06B 2009/2627
USPC ..... 160/84.05, DIG. 7; 428/116
See application file for complete search history.

(56) References Cited

U.S. PATENT DOCUMENTS

| | | | | |
|---|---|---|---|---|
| 2,118,134 | A | 5/1938 | Allison | |
| 2,201,356 | A | 5/1940 | Terrell | |
| RE22,311 | E | 5/1943 | Roy | |
| 2,318,525 | A | 5/1943 | Renton | |
| 3,370,972 | A * | 2/1968 | Nagel et al. | 428/216 |
| 3,386,490 | A | 6/1968 | Kandel | |
| 3,487,875 | A | 1/1970 | Shukat et al. | |

(Continued)

FOREIGN PATENT DOCUMENTS

| | | | |
|---|---|---|---|
| AU | 622268 | B2 | 9/1991 |
| AU | 2004308391 | B2 | 7/2005 |

(Continued)

OTHER PUBLICATIONS

Jindal, Bicor 42MB777 Oriented Polypropylene Films, retrieved from (http://www.jindalfilms.com/wp-content/uploads/jindal-products/productpdf/Bicor_42MB777_SI_102.pdf).*

(Continued)

*Primary Examiner* — Katherine Mitchell
*Assistant Examiner* — Abe Massad
(74) *Attorney, Agent, or Firm* — Dorsey & Whitney LLP

(57) ABSTRACT

A cellular covering for an architectural opening includes a plurality of elongated, longitudinally connected and transversely collapsible cellular units composed of inner and outer cells where the outer cell is a woven, knit, or non-woven product and the inner cell is an air-impermeable film which may be treated to be a low-modulus film with acceptable surface tension so that the panel formed from the cellular units has improved insulative properties and has a relatively long life.

25 Claims, 4 Drawing Sheets

(56) References Cited

U.S. PATENT DOCUMENTS

| | | | | |
|---|---|---|---|---|
| 3,490,515 | A | 1/1970 | Kandel | |
| RE29,340 | E * | 8/1977 | Matsunami et al. | 428/216 |
| 4,069,857 | A | 1/1978 | Brookshire | |
| 4,397,346 | A | 8/1983 | Chumbley et al. | |
| D277,061 | S | 1/1985 | Picoy | |
| 4,542,602 | A | 9/1985 | Hoverson | |
| 4,675,060 | A | 6/1987 | Schnebly et al. | |
| 4,677,013 | A | 6/1987 | Anderson | |
| 4,739,816 | A | 4/1988 | Dodich et al. | |
| 4,751,115 | A | 6/1988 | Smith et al. | |
| 4,846,243 | A | 7/1989 | Schneider | |
| 4,884,612 | A | 12/1989 | Schnebly et al. | |
| 4,915,153 | A | 4/1990 | Toti | |
| 4,921,032 | A | 5/1990 | May | |
| 4,974,656 | A | 12/1990 | Judkins | |
| 4,984,617 | A | 1/1991 | Corey | |
| 5,037,700 | A | 8/1991 | Davis | |
| 5,090,098 | A | 2/1992 | Seveik et al. | |
| 5,129,440 | A | 7/1992 | Colson | |
| 5,158,632 | A | 10/1992 | Colson et al. | |
| 5,193,601 | A | 3/1993 | Corey et al. | |
| 5,205,333 | A * | 4/1993 | Judkins | 160/84.02 |
| 5,207,257 | A | 5/1993 | Rupel et al. | |
| 5,296,974 | A | 3/1994 | Tada et al. | |
| 5,313,998 | A | 5/1994 | Colson et al. | |
| 5,409,050 | A | 4/1995 | Hong | |
| 5,425,408 | A | 6/1995 | Colson | |
| 5,482,750 | A * | 1/1996 | Colson et al. | 428/12 |
| 5,490,533 | A | 2/1996 | Carter | |
| 5,503,210 | A | 4/1996 | Colson et al. | |
| 5,547,006 | A | 8/1996 | Auger | |
| 5,560,976 | A | 10/1996 | Huang | |
| 5,566,735 | A | 10/1996 | Jelic | |
| 5,620,035 | A | 4/1997 | Judkins | |
| 5,632,316 | A | 5/1997 | Cohen | |
| 5,649,583 | A | 7/1997 | Hsu | |
| 5,690,156 | A | 11/1997 | Ruggles | |
| 5,706,876 | A | 1/1998 | Lysyj | |
| 5,746,266 | A | 5/1998 | Colson et al. | |
| 5,787,951 | A | 8/1998 | Tonomura et al. | |
| 5,791,390 | A | 8/1998 | Watanabe | |
| 5,974,763 | A * | 11/1999 | Colson et al. | 52/793.1 |
| 6,006,812 | A | 12/1999 | Corey | |
| 6,033,504 | A | 3/2000 | Judkins | |
| 6,052,966 | A * | 4/2000 | Colson et al. | 52/793.1 |
| 6,103,336 | A | 8/2000 | Swiszcz | |
| D436,783 | S | 1/2001 | Cooper et al. | |
| 6,257,300 | B1 | 7/2001 | Brownlie | |
| D448,594 | S | 10/2001 | Throne | |
| 6,302,181 | B1 | 10/2001 | Rupel | |
| 6,345,486 | B1 | 2/2002 | Colson et al. | |
| 6,354,353 | B1 | 3/2002 | Green et al. | |
| 6,461,464 | B1 | 10/2002 | Swiszcz | |
| 6,497,264 | B1 | 12/2002 | Paskevicius | |
| 6,520,238 | B2 | 2/2003 | Allsopp | |
| 6,550,519 | B2 | 4/2003 | Green et al. | |
| 6,572,725 | B2 | 6/2003 | Goodhue | |
| 6,601,637 | B2 | 8/2003 | Toti | |
| 6,662,845 | B1 | 12/2003 | Palmer | |
| 6,675,859 | B2 | 1/2004 | Nien | |
| 6,767,615 | B1 * | 7/2004 | Judkins et al. | 428/178 |
| 6,792,996 | B1 | 9/2004 | Yu et al. | |
| D498,105 | S | 11/2004 | Tyner | |
| 6,834,702 | B2 | 12/2004 | Nien | |
| D501,749 | S | 2/2005 | Gruner | |
| 6,932,138 | B2 | 8/2005 | Yu et al. | |
| 6,988,526 | B2 | 1/2006 | Judkins | |
| D514,859 | S | 2/2006 | Herhold et al. | |
| 7,021,359 | B2 | 4/2006 | Yu et al. | |
| 7,117,919 | B2 | 10/2006 | Judkins | |
| 7,124,802 | B2 | 10/2006 | Sudano | |
| 7,131,479 | B1 * | 11/2006 | Marusak | E06B 9/262 160/10 |
| 7,143,802 | B2 | 12/2006 | Strand et al. | |
| 7,159,634 | B1 | 1/2007 | Judkins | |
| 7,191,816 | B2 | 3/2007 | Colson et al. | |
| 7,275,580 | B2 | 10/2007 | Yu et al. | |
| 7,290,582 | B2 | 11/2007 | Lin | |
| 7,353,856 | B2 | 4/2008 | Pon et al. | |
| D568,082 | S | 5/2008 | Bohlen | |
| 7,415,845 | B1 | 8/2008 | Graichen | |
| 7,513,292 | B2 | 4/2009 | Auger et al. | |
| 7,523,777 | B2 | 4/2009 | Kim | |
| D605,885 | S | 12/2009 | Judkins | |
| 7,637,301 | B2 | 12/2009 | Forst Randle | |
| 7,763,555 | B2 * | 7/2010 | Nguyen | E06B 9/02 428/219 |
| 7,832,450 | B2 | 11/2010 | Brace et al. | |
| D636,204 | S | 4/2011 | Elinson et al. | |
| D640,472 | S | 6/2011 | Colson et al. | |
| D646,516 | S | 10/2011 | Ehrsam | |
| D663,147 | S | 7/2012 | Cheng | |
| D668,090 | S | 10/2012 | Colson et al. | |
| 8,568,859 | B2 * | 10/2013 | Yu et al. | 428/178 |
| D693,600 | S | 11/2013 | Jelic et al. | |
| 8,763,673 | B2 | 7/2014 | Jelic et al. | |
| 2002/0043346 | A1 | 4/2002 | Zorbas | |
| 2002/0043347 | A1 | 4/2002 | Rupel | |
| 2004/0065417 | A1 | 4/2004 | Vanpoelvoorde | |
| 2004/0079492 | A1 | 4/2004 | Lin | |
| 2005/0155721 | A1 | 7/2005 | Pon | |
| 2005/0155722 | A1 | 7/2005 | Colson et al. | |
| 2006/0048901 | A1 | 3/2006 | Nien | |
| 2006/0260272 | A1 | 11/2006 | Swiszcz et al. | |
| 2007/0074826 | A1 | 4/2007 | Jelic et al. | |
| 2007/0183053 | A1 | 8/2007 | Ellemor | |
| 2008/0083508 | A1 | 4/2008 | Rossato | |
| 2008/0286569 | A1 | 11/2008 | Husemann et al. | |
| 2010/0095535 | A1 | 4/2010 | Akins et al. | |
| 2010/0126675 | A1 | 5/2010 | Jelic et al. | |
| 2010/0139873 | A1 | 6/2010 | Gardner | |
| 2010/0186903 | A1 | 7/2010 | Liang et al. | |
| 2010/0276088 | A1 | 11/2010 | Jelic et al. | |
| 2010/0276089 | A1 | 11/2010 | Jelic et al. | |
| 2010/0288446 | A1 | 11/2010 | Foley et al. | |
| 2011/0088852 | A1 | 4/2011 | Hu et al. | |
| 2012/0103537 | A1 | 5/2012 | Dogger | |
| 2012/0175068 | A1 | 7/2012 | Cleaver | |
| 2012/0175069 | A1 | 7/2012 | Rupel et al. | |
| 2014/0168779 | A1 * | 6/2014 | Malkan | 359/614 |
| 2014/0224432 | A1 | 8/2014 | Josephson et al. | |
| 2014/0284004 | A1 | 9/2014 | Sevcik et al. | |

FOREIGN PATENT DOCUMENTS

| | | | |
|---|---|---|---|
| CA | 2344617 | A1 | 10/2001 |
| CN | 2545343 | Y | 4/2003 |
| CN | 2862889 | Y | 1/2007 |
| CN | 1965194 | A | 5/2007 |
| CN | 101193995 | A | 6/2008 |
| DE | 2843405 | A1 | 4/1980 |
| DE | 29910899 | U1 | 10/1999 |
| EP | 0427477 | A2 | 5/1991 |
| EP | 0451912 | A1 | 10/1991 |
| EP | 0779407 | A1 | 6/1997 |
| EP | 1431506 | A2 | 6/2004 |
| EP | 1479867 | A2 | 11/2004 |
| EP | 1561896 | A2 | 8/2005 |
| EP | 1561986 | A1 | 8/2005 |
| EP | 1619348 | A1 | 1/2006 |
| JP | 37-26369 | | 9/1937 |
| JP | 2000/185360 | A | 7/2004 |
| JP | 2004/250858 | A | 9/2004 |
| JP | 2005/139668 | A | 6/2005 |
| JP | 2007/092245 | A | 4/2007 |
| WO | 87/06187 | A1 | 10/1987 |
| WO | 88/07345 | A1 | 10/1988 |
| WO | 93/07353 | A1 | 4/1993 |

OTHER PUBLICATIONS

ExxonMobil Chemical, "Oppalyte™ 36MO747 Oriented Polypropylene Film," Multi-Plastics, Inc. (Oct. 26, 2009), 3 pages.

(56) References Cited

OTHER PUBLICATIONS

Innovia Films, "Propafilm™ RD," www.innoviafilms.com (date unknown), 2 pages.
Plastics Technology, "No. 47—Biaxial Film Orientation: Plastics Technology," http://www.ptonline.com/articles/no-47---biaxial-film-orientation, (Oct. 2005), 2 pages.
Author Unknown, "Jindal Films", Jindal Films, Oppalyte 36MO747, Multi-Plastics, Inc., 4 pages, Jun. 15, 2010.
Author Unknown, "Roman Shades", seamstobe.com/Romanshades.htm, at least as early as May 26, 2009, 2 pages.
Author Unknown, "Understanding Roman Shades", terrelldesigns.com, at least as early as May 26, 2009, 4 pages.

* cited by examiner

PLASTIC DOUBLE-CELL COVERING FOR ARCHITECTURAL OPENINGS

CROSS-REFERENCE TO RELATED APPLICATIONS

This application is the national stage application of PCT International Patent Application No. PCT/US2011/041217 entitled "Plastic Double-Cell Covering For Architectural Openings" filed on Jun. 21, 2011, which claims priority under 35 U.S.C. §119(e) to U.S. provisional patent application No. 61/357,635 entitled "Plastic Double-Cell Covering For Architectural Openings" filed on Jun. 23, 2010, which applications are hereby incorporated by reference herein in their entireties.

BACKGROUND OF THE INVENTION

1. Field of the Invention

The present invention relates generally to retractable cellular coverings for architectural openings, such as windows, doors, archways, and the like, and more particularly to such a covering wherein concentric double cells are used to improve the insulating properties of the covering without detrimentally affecting the thickness, color, sound of operation, and the like of the covering.

2. Description of the Relevant Art

Coverings for architectural openings, such as windows, doors, archways, and the like, have taken numerous forms for many years with some of these coverings being retractable in nature so as to be moveable between an extended position across the opening and a retracted position adjacent one or more sides of the opening.

More recently, retractable coverings have been made in a cellular format for aesthetics and in some instances for improved insulation. The cells in such coverings are typically elongated and transversely collapsible so that when the covering is extended across a window opening, the cells are themselves expanded, but when the covering is retracted adjacent one or more sides of the opening, the cells collapse transversely so that the covering can be neatly stacked adjacent the one or more sides of the opening.

One form of such a cellular covering typically includes a plurality of elongated vertically aligned, horizontally extending, transversely collapsible cells which are longitudinally adhered to adjacent cells to form a vertical stack of cells. The transverse cross-section of each cell can take numerous forms such as hexagonal, octagonal, or variations thereof. While such coverings utilizing transversely collapsible cells are typically oriented so the cells extend horizontally, panels of such material can also be oriented so the cells extend vertically.

While such cellular coverings may have some insulative capabilities, depending largely on the material from which they are made, there has been a continuing effort to improve the insulating capabilities of such coverings with an example of such being in U.S. Pat. No. 5,974,763 owned by the assignee of the present application. In that patent, cells are provided within other cells with the arrangement commonly referred to as a cell-in-cell, and this arrangement provides improved insulation even though issues are raised with the thickness of the covering when it is retracted and such issues are addressed in the aforenoted U.S. patent. Further, dependent upon the see-through capability of the fabric from which the outer cells in such a covering is made, the inner cell might also have an effect on the see-through capability of the covering whether it is transparent or translucent. Of course, if the outer cell were opaque, the light-transmitting characteristics of the inner cell would have no bearing. Coloring of the inner and outer cells is also a factor in the aesthetics of the product where the outer cells are made of a transparent or translucent material.

Typically, both the outer and inner cells are made of a woven or non-woven material which could be of natural or synthetic fibers and may include a resin to bond the fibers. When cell-in-cells are utilized in a retractable covering and when both cells are made of such a woven or non-woven material, the see-through capability is typically adversely affected, and as mentioned previously, the coloring and stacking capabilities can also be adversely affected.

It is an object of the present invention to provide a cell-in-cell retractable covering for architectural openings which improves upon the characteristics of prior art coverings.

SUMMARY OF THE INVENTION

The retractable covering of the present invention includes a plurality of elongated horizontally extending, transversely collapsible cell-in-cell units which are longitudinally secured to upper and lower like units to form a transversely collapsible cellular panel. While the outer cell can be made of a woven, knit, or non-woven fabric of natural or synthetic fibers, the inner cell is made of a low modulus film having relatively high surface tension so it can be bonded to the outer cell in a manner which is dependable at high temperatures such as are experienced in windows, doors, and the like. Of course, the cells could be oriented vertically rather than horizontally, if desired.

Other aspects, features and details of the present invention can be more completely understood by reference to the following detailed description of a preferred embodiment, taken in conjunction with the drawings and from the appended claims.

DETAILED DESCRIPTION OF THE INVENTION

Figure 1:
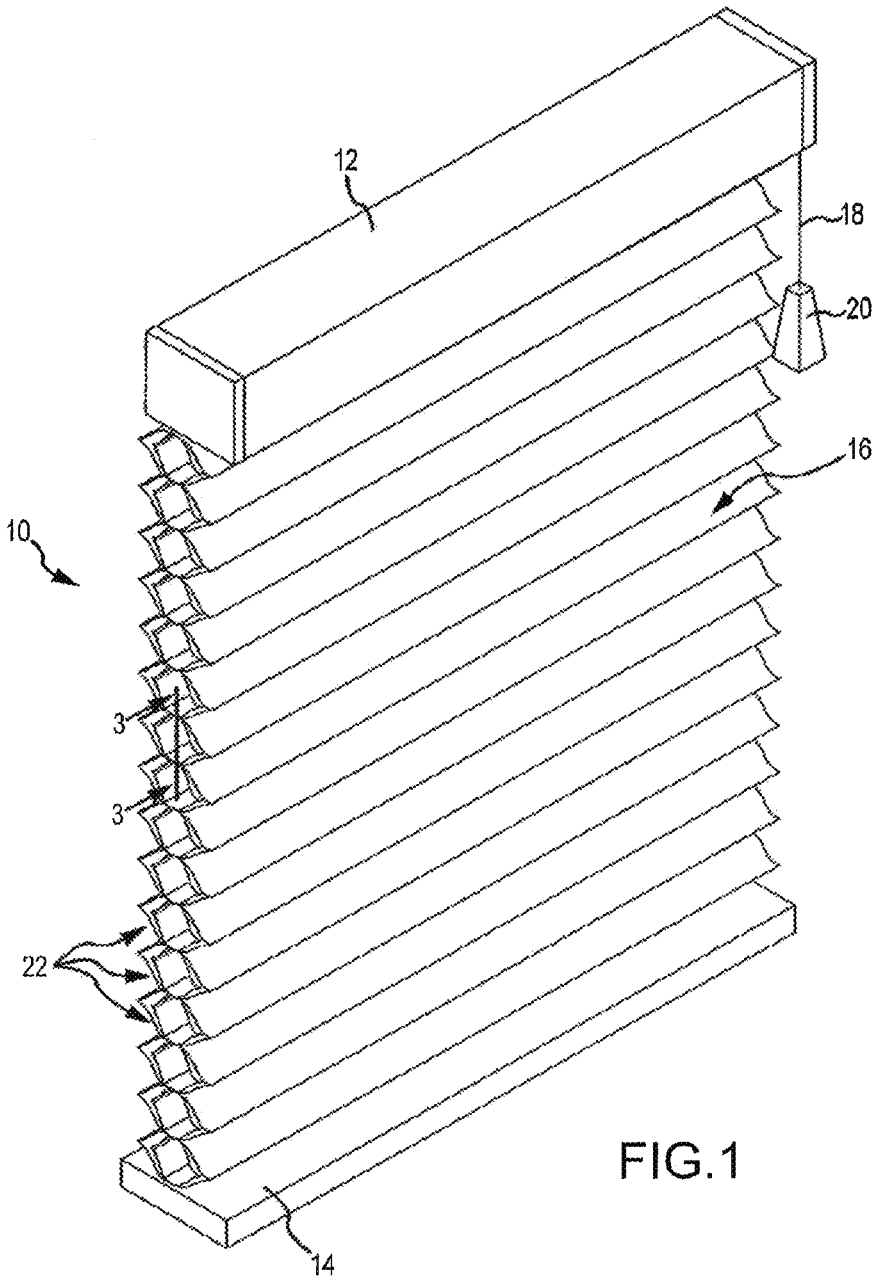
FIG. 1 is an isometric of a fully-extended covering in accordance with the present invention.
Figure 2:
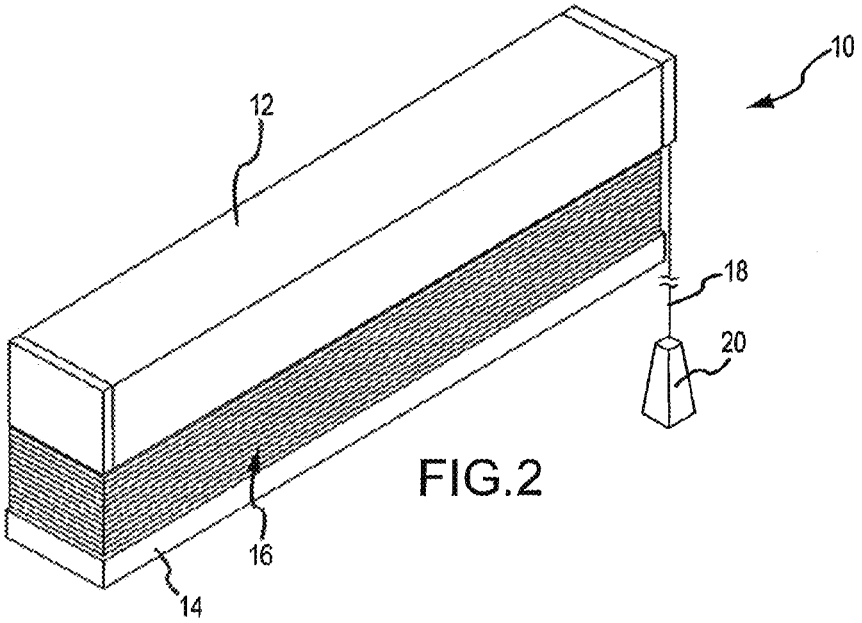
FIG. 2 is an isometric similar to FIG. 1 with the covering in a fully-retracted position.

A covering 10 incorporating the teachings of the present invention is shown fully extended in FIG. 1 and fully retracted in FIG. 2. The covering can be seen to include a headrail 12, a bottom rail 14, and a flexible collapsible panel 16 interconnecting the headrail and the bottom rail. The covering is moved from the extended position of FIG. 1 to the retracted position of FIG. 2 in a conventional way utilizing a control system that is incorporated into the headrail and is operated with a pull cord 18 having a tassel 20 on a free end thereof, with the pull cord being operative to retract lift cords (not seen) which extend through the panel from the headrail to the bottom rail and are thereby operative to lift the bottom rail toward the headrail when the covering is being retracted. The covering would be extended from the retracted position of FIG. 2 by allowing the tassel to rise and therefore extend the lift cords permitting the bottom rail to drop by gravity. A conventional cord lock (not seen) is provided within the headrail to secure the pull cord at any desired position between fully extended and fully retracted positions.

The flexible panel 16 is comprised of a plurality of elongated horizontally extending, vertically aligned and transversely collapsible cellular units 22 which are interconnected along their length to immediately adjacent upper and lower identical cellular units in a manner to be described hereafter. The cellular units can be seen best, for example, in FIG. 3 to include an outer cell 24 and an inner cell 26, which are similarly configured even though the inner cell is obviously smaller in cross-section than the outer cell. Both the inner and outer cells are made from a strip of material that is flexible or semi-rigid so as to have enough rigidity to temporarily retain the configuration shown in FIG. 3, for example, when the covering is fully extended and can be transversely collapsed into a flattened configuration as in FIG. 2 by moving the bottom of each cellular unit into contiguous relationship with the top of the cellular unit.

Figure 3:
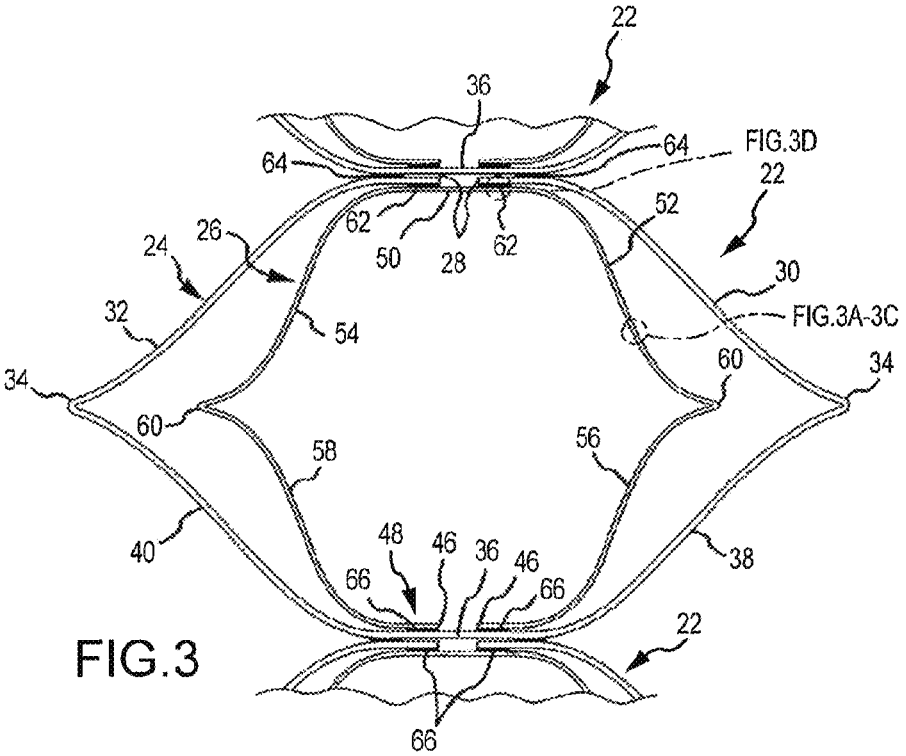
FIG. 3 is an enlarged fragmentary section taken along line 3-3 of FIG. 1.

The outer cell 24 of the cellular unit is made from a strip of material having parallel longitudinal edges 28, which are positioned in spaced adjacent relationship from each other at the top of the cell, as seen in FIG. 3, and having upper side walls extending in opposite directions with one upper side wall 30 being referred to as an inner upper side wall and the other an outer upper side wall 32. The inner upper side wall faces the interior of a room (not shown), while the outer upper side wall would face the exterior of the room, such as, for example, a glass pane in a window (not shown). The strip of material is longitudinally creased at two locations 34 which are equally spaced from the longitudinal edges 28 of the strip of material so as to be somewhat pointed with one crease facing the interior of a room and the other the exterior of a room. The outer cell has a longitudinally extending bottom wall 36 which is identifiable when the cell is expanded as in FIG. 3, with the bottom wall being interconnected to the creases 34 with an inner lower side wall 38 and an outer lower side wall 40. The proximity of the longitudinal edges of the strip of material at the top of each cell cooperate to define the top wall 42 of the cell so that each outer cell has a top wall, a bottom wall 36, an upper inner side wall 30, an upper outer side wall 32, a lower inner side wall 38, and a lower outer side wall 40.

The inner cell 26 is structured identically to the outer cell except that it is inverted so that the longitudinal edges 46 of the strip of material from which it is formed are positioned in spaced immediately adjacent relationship to each other forming a bottom wall 48 of the cell with the top of the cell defining a top wall 50 that is continuous. In some examples, the inner cell 26 may be an orientated polypropylene film that may include a polyvinylidene chloride coating and/or an acrylic coating. And, in other examples, the inner cell 26 may include a first or base material that may form the main structure of the inner cell 26 and the oriented polypropylene film may be applied onto the outer surface of the base material 69 (FIG. 3D) to create an impermeable cell.

The inner cell 26, like the outer cell 24, has an upper inner side wall 52, an upper outer side wall 54, a lower inner side wall 56, and a lower outer side wall 58, with the upper and lower side walls on the inner and outer sides being connected by creases 60 in the strip of material forming the inner cell 26.

Each cellular unit 22 is connected to an adjacent cellular unit with lines of adhesive, for example, but could also be ultrasonically bonded or connected in any other suitable manner that would withstand the elevated temperatures incurred in windows or doorways of a building structure.

If the cells of a unit 22 and the interconnection of one cellular unit to another are accomplished with adhesive, the adhesive preferably has a bonding or glue strength in excess of four pounds. Accordingly, the adhesive as well as the material used in the cells may be compatible enough to provide such bonding strength at the elevated temperatures incurred such as, for example, up to 225° F.

With reference to FIG. 3, it will be seen that lines of adhesion or glue lines 62 are provided on the bottom surface of the top wall 42 immediately adjacent to the longitudinal edges 28 of the outer cell 24 while corresponding lines of adhesive 64 are positioned on the top surface of the outer cell 24 at a slightly spaced distance from the longitudinal edges 28. The adhesive 62 on the bottom surface of the outer cell adjacent the longitudinal edges is used to secure the outer cell to the top wall 50 of the inner cell 26 while the lines of adhesive 64 on the top surface immediately spaced from the longitudinal edges of each outer cell is used to secure the top wall 42 of one outer cell to the bottom wall 36 of the upwardly next adjacent outer cell. Also, in each cellular unit, lines of adhesive 66 are provided along the bottom surface of the longitudinal edges 46 of the inner cell 24 so as to secure the outer surface of the bottom wall 48 of the inner cell to the inner surface of the bottom wall 44 of the outer cell.

While the adhesive used may best perform when it satisfies the criteria mentioned above, it has been found that an adhesive made by Henkel International of 1001 Trout Block Crossing, Rocky Hill, Conn. 06067 USA, and sold under the trade name Moisture Curable Polyurethane Henkel Adhesives, has been found suitable for this use.

While the outer cell 24 could be made of most any material which is to some degree dictated by aesthetics and light transmissivity including transparent, translucent, or opaque fabrics, woven, knit, or non-woven fabrics which might include a resin for bonding the fibers used in the fabrics, are typically used and are translucent in their light-transmitting character. The outer cells typically also have some air permeability. The material from which the outer cells are made will further collapse and expand in a substantially silent manner so there are no undesired noises from the fabric cells themselves when the covering is moved between extended and retracted positions.

In order to provide optimum insulation, the inner cell 26, pursuant to the present invention, is made of an air impermeable material such as a synthetic film. A problem with most synthetic films, however, is that they are noisy when folded and unfolded so as to make a "crunchy" sound, at least when they are thick enough to at least temporarily hold their configuration. This, of course, is undesirable in covering products of the type described herein and, accordingly, the air impermeable material, while being a film, is desirably relatively silent when it is collapsed and expanded. Another common feature of most films such as polyester "Mylar" type films is that they have very low surface tension and, accordingly, adhesives may not bond well and may not provide the bonding strength required for a product of the type described herein. Low modulus films can be used to minimize the noise factor, but are typically characterized by low surface tension and are, therefore, not universally suitable for use in a covering of the type disclosed herein. Another factor to consider when selecting a film-type product for the inner cell of a cellular unit is how that film might affect the handling of the cells when they are being manufactured and connected to adjacent cells. This might be referred to as the "handling" of the cellular materials, and this is a factor for consideration similar to the noise factor and the surface tension factor mentioned above. Another factor to be considered when selecting the film is the thickness of the film as this will also affect the handling when processing the cellular units as well as the noise factor and the retracting thickness of the finished product.

Oriented Polypropylene (OPP) films are low-modulus and in addition provide product stability, ease of handling, and move desirably and quietly between expanded and retracted positions of the covering product. In some examples, OPP films may be biaxially orientated, which may allow the films to be substantially clear. This may allow the color of a material (if any) on which the OPP film is applied to be visible through the coating. Additionally, when the OPP is biaxially orientated, the tensile strength, flexibility, and toughness of the film may be increased.

Such OPP films typically include an acrylic coating on both sides. The acrylic coating, however, has a low surface tension so that dependable glue strengths above four pounds are not always obtainable.

It has been found in accordance with the present invention, however, that by providing a coating on at least one side of an OPP film of a polyvinylidene chloride (PVDC) an acceptable adhesion is obtainable for use in a covering for an architectural opening. In some examples, the PVDC coating may be an aqueous dispersion of PVDC copolymer. Additionally, the PVDC coating also has a melting/softening point above 225° F., which is beneficial for coverings of the type disclosed herein.

An example of a film product arrived upon pursuant to the present invention for providing the desired insulation, handling, stability, and strength criteria desired for the covering product 10 is an OPP film of 1.5 mil in thickness and having a PVDC coating on one side. A film product meeting that criteria can be purchased from Innovia Films having a principal place of business in England and sold under the product identification RD140. In this application, the term OPP film includes a single layer film structure of entirely OPP, or a multi-layer film structure of OPP and any one or more of the additional film materials described herein, or other film materials known to be suitably used along with OPP for compatible purposes.

As described above, with respect to FIG. 3, the inner cell 26 may be structurally similar to the outer cell 24. However, the inner cell 26 may be formed of an OPP film or an OPP film coated on a base material. While FIGS. 3A-3C show an enlarged section view of wall 52 of inner cell 26, these views are representative of the structure of any of the walls 52, 54, 56, 58, any combination of the walls 52, 54, 56, 58, all of the walls 52, 54, 56, 58, or any portion of any one or more of the walls 52, 54, 56, 58.

Figure 3A:
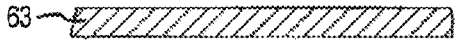
FIG. 3A is an enlarged view of the fragmentary section of FIG. 3 showing an inner cell formed of an oriented polypropylene film.

FIG. 3A is an enlarged view of a first example of wall 52 of the inner cell 26 formed of an OPP film 63. In this example, the inner cell 26 may be formed completely of the OPP film 63, which provides air impermeability and insulation qualities. In addition to forming the inner cell 26 with only the OPP film 63, in some examples, the inner cell 26 may also include additional layers.

Figure 3B:
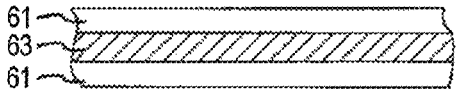
FIG. 3B is an enlarged view of the fragmentary section of FIG. 3 showing a second example of the inner cell formed of an orientated polypropylene film having an acrylic layer on each side of the orientated polypropylene film.

As seen in FIG. 3B, the acrylic coating 61 may be positioned on both surfaces of the OPP film 63. However, as discussed above, the acrylic coating 61 may present some difficulties in attaching the inner cell 26 to the outer cell 24. Therefore, in some instances, the acrylic coating 61 may be included on the inner surface of the inner cell 26, rather than on the outer surface of the inner cell 26 that engages outer cell 24.

Figure 3C:
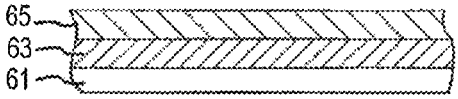
FIG. 3C is an enlarged view of the fragmentary section of FIG. 3 showing a third example of the inner cell formed of the oriented polypropylene film having a polyvinylidene chloride layer on an outer surface and an acrylic layer on an inner surface.

FIG. 3C is an enlarged view of a third example of the inner cell 26. In this example, the OPP film 63 may include the acrylic coating 61 on an inner surface and a PVDC coating 65 on the outer surface of the OPP film 63. In this example, the PVDC coating 65 may provide acceptable adhesion properties to facilitate attachment of the inner cell 26 to the outer cell 24. As described above, the PVDC coating 65 provides a higher surface tension than the acrylic layer 61. The PVDC coating 65 may be layered on the OPP film 63 so that the adhesive line 62 (see FIG. 3) may be able to provide an acceptable adhesion to attach the inner cell 26 to the outer cell 24. Therefore, the PVDC coating 65 may be applied to the OPP film 63 at all or some of the locations where the inner cell 26 and outer cell 24 are attached together, or may be applied on the entire outer surface of the OPP film 63 forming the inner cell 26.

The OPP film 63 provides insulative qualities to the inner cell 26, while reducing the operational noise (i.e. the "crunchy" sound) as the panel is extended and retracted. This is because the OPP film 63 may produce a reduced amount of sound as the cellular pane is expanded and retraced. It should be noted that in other examples, e.g., FIGS. 3A-3C, the OPP film 63, acrylic layer 61 or PVDC coating 65 may be non-transparent and/or may include colors or other surface effects.

However, in still other examples, the inner cell 26 may be constructed of a base material with a layer of OPP film 63 applied to its outer surface. See FIG. 3D. For example, in some instances, the OPP film 63 may be clear and therefore, the color of a base material may be viewable through the OPP film 63.

Figure 3D:
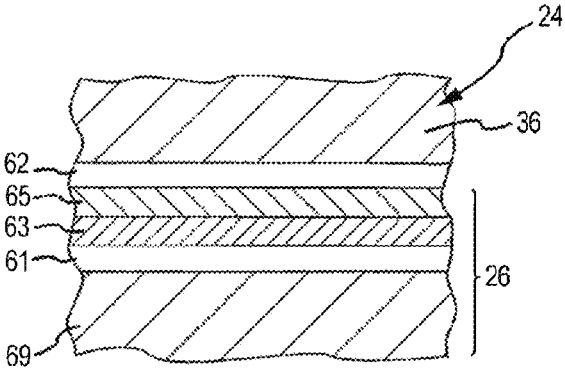
FIG. 3D is an enlarged view of the fragmentary section of FIG. 3 showing a fourth example of the inner cell having a base material coated with the orientated polypropylene film, including an acrylic coating on a first or inner side and a polyvinylidene chloride coating on a second or outer side of the orientated polypropylene film.
Figure 4:
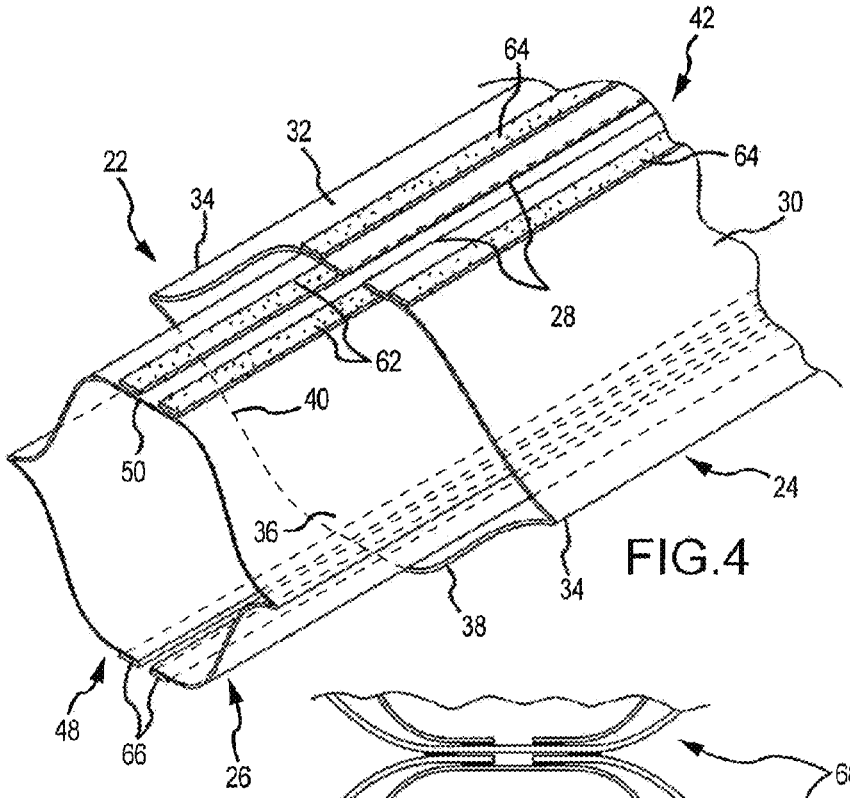
FIG. 4 is an exploded diagrammatic isometric showing the inner and outer cells used in the covering of FIGS. 1 and 2, and the lines of adhesive for interconnecting the cells.

FIG. 3D is a fourth example of an inner cell 26. This representative section is taken along wall section 50 where the inner cell 26 and the outer cell 24 are connected together. In this example, the inner cell 26 may include a base material 69, with the acrylic coating 61, OPP film 63 and the PVDC coating 65 together forming a layered film applied to the outer surface of the base material 69. This example is similar to having the film layer of FIG. 3C applied to the outer surface of inner cell 26 formed of a base layer 69. The base material 69 that may be a transparent, translucent, or opaque fabric, woven, knit, or non-woven fabric such as the material used in the formation of outer cell 24, and suitable for use in the structure of the inner cell 26. It should be noted the inner cell 26 may be similarly configured at other locations.

As discussed above with respect to FIG. 3C, the PVDC coating 65 may be selectively applied to the regions between the OPP film 63 and the adhesive line 62 to facilitate an improved attachment between the outer 24 and inner 26 cells. As noted above, adhesive line 62 better adheres to this layer of PVDC than if applied directly to the acrylic layer 61. The PVDC coating 65 may be adhered or layered along only the portions of the inner cell 26 that may be connected to the outer cell 24, e.g., beneath the adhesive lines 62, or may be applied to other portions, such as the entire inner cell 26 also. Similarly, the OPP film 63 may be layered on the top, bottom, and front or back side of the base material 69. In this manner, the inner cell 26 may be more air permeable than embodiments where the OPP film 63 forms the entire inner cell 26, as the first or base material of the inner cell 26 (which may be a fabric, knit, woven, or non-woven) may permit more air transfer there through than the more insulating OPP film 63.

In the aforementioned examples, the inner cell 26 may include a variety of different films having at least one layer of a synthetic film, such as OPP.

It has been found that a panel 16 made of cellular units 22 as described herein provides an R-value factor of 4.66 when the cells have a height of ¾ inches from the top wall to the bottom wall of the cellular unit. This is comparable to other cellular products having the same outer cell but no inner cell which have an R-value of 3.79. These values in turn are comparable to that of a double-paned glass window that would have an R-value of 3.50. Accordingly, it can be seen that a cellular product made in accordance with the present invention has dramatically improved insulation. It is also a characteristic of the cellular units of the present invention that the adhesive lines all have a strength in excess of 6.5 pounds and the cells can be moved between extended and retracted positions a much reduced noise level, such as without hearing a "crunchy" noise.

It should also be noted that many cellular products used in coverings for architectural openings have the inner wall (facing the interior of a room) of a pre-selected color and the outer wall of a white color, which might be obtained by dyeing or coating the material with acceptable materials which are well known in the trade. It has also been determined that the different qualities of the inner and outer faces of the outer cell have a bearing on the adhesive strength, but pursuant to the present invention, the strength at each location of a line of adhesive never drops below 6.5 pounds, which is acceptable for a product of the type described.

Figure 5:
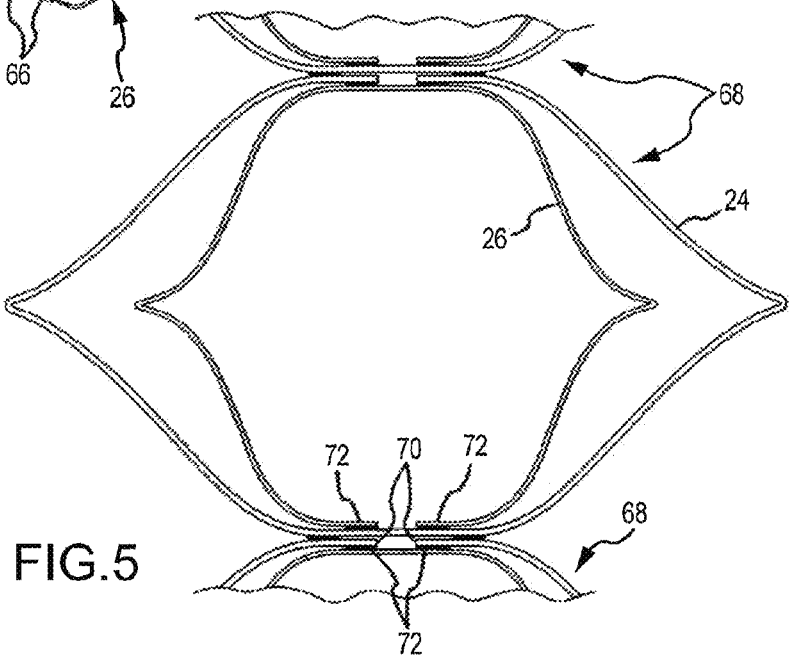
FIG. 5 is a section similar to FIG. 3 with the lines of adhesive in different locations than shown in the embodiment of FIGS. 3 and 4.

With reference to FIG. 5, it will be seen that the cellular unit 68 is slightly different than that of FIG. 3, even though the inner 26 and outer 24 cells are identical and oriented identically to each other. The only difference in the cellular structure shown in FIG. 3 and FIG. 5 resides in the fact that lines of adhesive 70 adjoining adjacent outer cells are vertically aligned with corresponding lines of adhesive 72 adjoining an inner cell to an outer cell. By changing the location of the lines of adhesive between the cellular units from that shown in FIG. 3 to that of FIG. 5, the shape and size of the outer cell would change slightly when the panel from which the cells are made is extended.

As described herein, material is referenced as "layers," without being limited to a sheet of contiguous thin material, unless defined to the contrary. For instance, a "layer" of a second material on a first material may be created by spraying, painting, or other type of deposition of the second material on a first material. Also, a sandwich layer of two or more materials may be exclusive of other film layers, or may be inclusive of other film layers positioned between, above or below the described film layers. As used herein, the terms "applied to," "coating," "positioned," or "adhered to," or "layered with" (or basic or derivative terms related thereto) may mean that one material at least partially overlies another material, either in direct contact or with layers of other materials between, above, or below the referenced materials, unless specifically described otherwise herein.

It should also be appreciated from the above that depending on the light transmitting characteristics of the inner and outer cells, the panel could be transparent, translucent or opaque.

Although the present invention has been described with a certain degree of particularity, it is understood the disclosure has been made by way of example, and changes in detail or structure may be made without departing from the spirit of the invention as defined in the appended claims.

What is claimed is:

1. A cellular covering for an architectural opening, said cellular covering comprising:

a plurality of interconnected elongated tubular transversely collapsible outer cells forming an expandable and collapsible panel movable between extended and retracted positions, wherein:

each said outer cell includes a tubular transversely collapsible inner cell secured within said outer cell by at least one adhesive line and expandable and collapsible with expanding and collapsing of said panel;

said inner cell comprises a transparent or translucent orientated polypropylene film and includes a polyvinylidene chloride coating overlying at least a portion of said orientated polypropylene film and positioned between said orientated polypropylene film and said outer cell;

said at least one adhesive line is positioned between said polyvinylidene chloride coating and said outer cell; and wherein said outer cells are air permeable.

2. The covering of claim 1, wherein said inner cell comprises a base layer with said orientated polypropylene film overlying at least a portion of said base layer.

3. The covering of claim 1, wherein said polyvinylidene chloride coating is positioned on an entire outer surface of said orientated polypropylene film.

4. The covering of claim 1, wherein said orientated polypropylene film has a thickness of approximately 1.5 mil.

5. The covering of claim 1, wherein said polyvinylidene chloride coating has a melting or softening point above 225° F.

6. A cellular panel for an architectural opening, said cellular panel comprising:

an outer cell;

an inner cell at least partially received within said outer cell, said inner cell formed of a translucent or transparent orientated polypropylene film;

a layer of polyvinylidene chloride overlying an outer surface of said oriented polypropylene film and positioned between said orientated polypropylene film and said outer cell;

a layer of adhesive positioned between said polyvinylidene chloride coating and said outer cell, wherein said adhesive layer secures said inner cell to said outer cell; and wherein said outer cell is air permeable.

7. The cellular panel of claim 6, wherein:

said outer cell is connected to said inner cell at a first location and a second location; and said layer of polyvinylidene chloride is positioned on said inner cell at least at one of said first location or said second location.

8. The cellular panel of claim 7, wherein said layer of polyvinylidene chloride is positioned on said inner cell at both said first location and said second location.

9. The cellular panel of claim 7, wherein said inner cell and said outer cell are connected together by said layer of adhesive at said first location and said second location.

10. The cellular panel of claim 7, wherein said orientated polypropylene film has a thickness of approximately 1.5 mil.

11. The cellular panel of claim 7, wherein said layer of polyvinylidene chloride has a melting or softening point above 225° F.

12. The cellular panel of claim 6, wherein said outer cell includes a first crease and a second crease equally spaced from a longitudinal edge of a strip of material.

13. The cellular panel of claim 6, wherein said inner cell includes a base material, and said orientated polypropylene film overlies an outer surface of said base material.

14. A cellular shade for covering an architectural opening, said cellular shade comprising:

a first cell that is translucent or transparent;

a second cell at least partially received within said first cell and constructed at least in part by substantially clear orientated polypropylene film and a polyvinylidene chloride coating overlying at least a portion of said orientated polypropylene film, said polyvinylidene chloride coating positioned between said orientated polypropylene film and said first cell;

an adhesive layer positioned between said polyvinylidene chloride coating and said first cell, wherein said adhesive layer secures said second cell to said first cell; and wherein said first cell is air permeable.

15. The cellular shade of claim 14, wherein said orientated polypropylene film is approximately 1.5 mil thick.

16. The cellular shade of claim 14, wherein said polyvinylidene chloride coating has a melting or softening point above 225° F.

17. The cellular shade of claim 14, wherein said second cell includes a base material, and wherein said orientated polypropylene film is attached to at least a portion of an outer surface of said base material.

18. The cellular covering of claim 1, wherein said oriented polypropylene film is substantially clear.

19. The cellular covering of claim 1, wherein said outer cells are transparent or translucent.

20. The cellular covering of claim 1, wherein said inner cell is secured to said outer cell along at least two peripherally-spaced longitudinal lines of attachment.

21. The cellular shade of claim 17, wherein said base material is transparent.

22. The covering of claim 1, wherein said orientated polypropylene film forms an innermost layer of said inner cell.

23. The cellular panel of claim 6, wherein said orientated polypropylene film forms an innermost layer of said inner cell.

24. The cellular panel of claim 6, wherein said outer cell is translucent or transparent.

25. The cellular shade of claim 14, wherein said orientated polypropylene film forms an innermost layer of said second cell.

* * * * *